US006226481B1

(12) United States Patent
Yoneda et al.

(10) Patent No.: US 6,226,481 B1
(45) Date of Patent: May 1, 2001

(54) IMAGE FORMING APPARATUS WITH CONTROL OVER DEVELOPING UNIT DURING AN IDLE RUNNING OF AN INTERMEDIATE IMAGE TRANSFER BODY

(75) Inventors: Takuzi Yoneda; Kazuyuki Sugihara; Takayuki Maruta, all of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/455,337

(22) Filed: Dec. 6, 1999

(30) Foreign Application Priority Data

Dec. 7, 1998 (JP) ..... 10-347280
Dec. 7, 1998 (JP) ..... 10-347296

(51) Int. Cl.[7] ..... G03G 15/01
(52) U.S. Cl. ..... 399/227; 399/53; 399/302
(58) Field of Search ..... 399/53, 55, 227, 399/231, 235, 222, 223, 265, 279, 281, 285, 302

(56) References Cited

U.S. PATENT DOCUMENTS

| | | | |
|---|---|---|---|
| 4,916,547 | 4/1990 | Katsumata et al. | 358/300 |
| 5,612,769 | 3/1997 | Sugihara et al. | 399/119 |
| 5,657,115 | 8/1997 | Sugihara | 399/263 |
| 5,671,470 | 9/1997 | Maruta et al. | 399/235 |
| 5,724,634 | 3/1998 | Maruta | 399/227 |
| 5,768,662 | 6/1998 | Sugihara et al. | 399/119 |
| 5,826,146 | 10/1998 | Maruta et al. | 399/235 |
| 5,835,825 | 11/1998 | Maruta | 399/227 |
| 5,970,278 | 10/1999 | Munakata | 399/46 |

FOREIGN PATENT DOCUMENTS

| | | |
|---|---|---|
| 7-152218 | 6/1995 | (JP) . |
| 8-76590 | 3/1996 | (JP) . |
| 8-190258 | 7/1996 | (JP) . |
| 9-106152 | 4/1997 | (JP) . |
| 11-174776 | 7/1999 | (JP) . |

*Primary Examiner*—Sophia S. Chen
*Assistant Examiner*—Hoan Tran
(74) *Attorney, Agent, or Firm*—Oblon, Spivak, McClelland, Maier & Neustadt, P.C.

(57) ABSTRACT

An image forming apparatus of the present invention includes a revolver type developing unit rotatably mounted on an apparatus body and having a plurality of developing sections, and an intermediate image transfer body having an endless movable surface to which a toner image is transferred from an image carrier. While the intermediate image transfer body is caused to run idle, the apparatus allows a minimum of toner apt to contaminate the background of a recording medium to be transferred from the developing section located at a developing position to the image carrier. Particularly, the apparatus frees the recording medium from contamination in the form of a band extending in the widthwise direction of the medium.

7 Claims, 6 Drawing Sheets

BK
Y
C
M
60msec
REVOLVER POTATION
ON
OFF
DEVELOPMENT CLUTCH
ON
OFF
MARK SENSOR OUTPUT
F GATE SIGNAL
CHARGER GRID VOLTAGE
ON
OFF
$KV_G$
$MV_G$
(NON-IMAGE PORTION)
DC COMPONENT
ON
OFF
$KV_{B-DC}$
$KV_{B-DC\ (REV)}$
$MV_{B-DC\ (REV)}$
$MV_{B-DC}$ FOR NON-IMAGE PORTION
AC COMPONENT
ON
OFF

*Fig. 6*

| DOCTOR GAP DG (mm) | AMOUNT OF DRAW $\rho$ (g/cm$^2$) | DEVELOPING GAP PG (mm) | | | | | |
|---|---|---|---|---|---|---|---|
| | | 0.50 | 0.55 | 0.60 | 0.65 | 0.70 | 0.75 |
| 0.562 | 0.040 | | | | | ROUGH | ROUGH |
| 0.600 | 0.045 | | ○ | ○ | ○ | ROUGH | ROUGH |
| 0.640 | 0.050 | | ○ | ○ | ○ | ○ | ROUGH |
| 0.677 | 0.055 | | ○ | ○ | ○ | ○ | |
| 0.712 | 0.060 | | ○ | ○ | ○ | ○ | |
| 0.754 | 0.065 | | | ○ | ○ | ○ | |
| 0.792 | 0.070 | | | | | | |
| 0.831 | 0.075 | | | | | | |

IMAGE FORMING APPARATUS WITH CONTROL OVER DEVELOPING UNIT DURING AN IDLE RUNNING OF AN INTERMEDIATE IMAGE TRANSFER BODY

BACKGROUND OF THE INVENTION

1. Field of the Invention

The present invention relates to a copier, facsimile apparatus, printer or similar image forming apparatus. More particularly, the present invention relates to an image forming apparatus of the type including a revolver type developing unit rotatably mounted on an apparatus body and having a plurality of developing sections, and an intermediate image transfer body having an endless movable surface to which a toner image is transferred from an image carrier.

2. Discussion of the Background

It is a common practice with an image forming apparatus of the type described to rotate a developing unit to bring a desired developing section thereof to a developing position for development, then cause an intermediate image transfer body carrying a toner image transferred from an image carrier to run idle, and then transfer the toner image from the image transfer body to a recording medium. For example, when a thick sheet mode for forming a toner image on, e.g., a thick sheet or an OHP (OverHead Projector) sheet is selected, the above idle run of the intermediate image transfer body is effected in order to slow down the movement of the body for again determining the position of the same. Further, when toner images sequentially formed on the image carrier by the developing sections are transferred to the intermediate image transfer body one above the other, it is likely that the leading edge of, e.g., the toner image of a first color formed on the image transfer body moves away from a transfer position where the image carrier and image transfer body face each other before the developing section assigned to a second color arrives at the developing position. In such a case, too, the intermediate image transfer body is caused to run idle.

However, the problem with the conventional image forming apparatus is that when the developing unit is inadvertently rotated during the idle run of the intermediate image transfer body, toner deposited on the image carrier by the developing section moving past or brought to the developing position is apt to deposit on the toner image forming area of the image transfer body. Such toner cause band-like contamination (lateral color band in the case of a color image) extending in the lateral or widthwise direction of a recording medium.

Technologies relating to the present invention are disclosed in, e.g., Japanese Patent Laid-Open Publication Nos. 7-152218, 8-76590, 8-190258, 9-106152, and 11-174776.

SUMMARY OF THE INVENTION

It is therefore an object of the present invention to provide an image forming apparatus capable of reducing, during the idle run of an intermediate transfer body, the background contamination of a recording medium ascribable to toner transferred from a developing section located at a developing position to an image carrier, particularly band-like contamination extending in the lateral direction of the recording medium.

In accordance with the present invention, an image forming apparatus includes an apparatus body. An image carrier carries a latent image thereon. A developing unit includes a plurality of developing sections each for developing a particular latent image formed on the image carrier to thereby produce a toner image. The developing unit is rotatably supported by the apparatus body. A drive source causes the developing unit to rotate. An intermediate image transfer body has an endless movable surface to which the toner image is transferred from the image carrier. A controller controls, while the intermediate image transfer body is running idle, the drive source such that one of the developing sections operated last before the start of the idle run remains at a developing position. Alternatively, the controller may control, while the intermediate image transfer body is running idle, the drive means such that one of the developing sections operated last before idle run is located at a position other than a developing position and such that none of the developing sections moves via the developing position.

Also, in accordance with the present invention, an image forming apparatus includes an apparatus body. An image carrier carries a latent image thereon. A developing unit includes a plurality of developing sections each for developing a particular latent image formed on the image carrier to thereby produce a toner image. The developing unit is rotatably supported by the apparatus body. A first drive mechanism for causes the developing unit to rotate. A second drive mechanism includes a drive gear capable of meshing with, among drive input gears respectively included in the developing sections, the drive input gear of one developing section brought to a developing position where the developing section faces the image carrier, thereby transmitting a drive force to a developer carrier included in the developing section. An intermediate image transfer body has an endless movable surface to which the toner image is transferred from the image carrier. The drive input gears and drive gear are arranged such that when any one of the developing sections moves toward the developing position while the intermediate image transfer body is running idle, a developer deposited on the developer carrier starts contacting the image carrier with the developer carrier rotating. A controller controls the first and second drive mechanisms.

Further, in accordance with the present invention, an image forming apparatus includes an apparatus body. An image carrier carries a latent image thereon. A latent image forming devices scans the uniformly charged surface of the image carrier with light in accordance with image data to thereby form a latent image on the image carrier. A developing unit includes a plurality of developing sections each for developing a particular latent image formed on the image carrier to thereby produce a toner image. The developing unit is rotatably supported by the apparatus body. A drive source causes the developing unit to rotate. A power supply applies a voltage to a developer carrier included in each of the developing sections. An intermediate image transfer body has an endless movable surface to which the toner image is transferred from the image carrier. One developing section located at a developing position is replaced with another developing section while the intermediate transfer body is running idle. A controller controls, while the intermediate image transfer body is running idle, the latent image forming device and power supply such that at least one of a condition for charging the image carrier and a condition for applying the voltage to the developer carrier of one developing section located at the developing position is switched to a condition causing a minimum of toner to move from the developer carrier to the image carrier to thereby reduce contamination of the background.

BRIEF DESCRIPTION OF THE DRAWINGS

The above and other objects, features and advantages of the present invention will become more apparent from the following detailed description taken with the accompanying drawings in which:

FIG. 6 is a table listing the results of experiments conducted with the illustrative embodiment.

DESCRIPTION OF THE PREFERRED EMBODIMENTS

Figure 2:
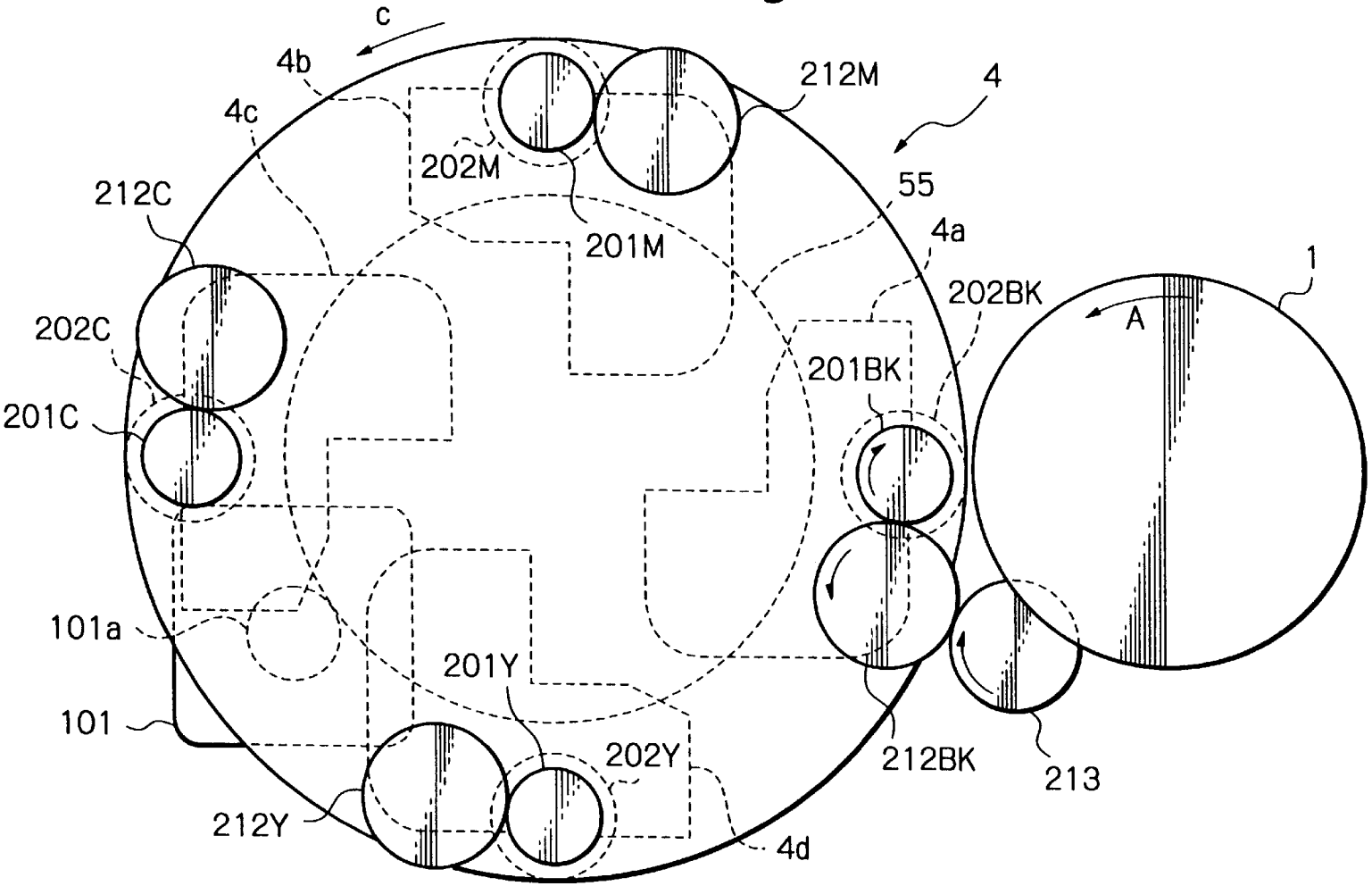
FIG. 2 is a view showing a drive arrangement for a revolver type developing unit included in the illustrative embodiment.

Referring to FIG. 2 of the drawings, an image forming apparatus embodying the present invention is shown and implemented as a full-color electrophotographic copier by way of example. The copier is generally made up of a scanner section or color image reading device, not shown, and a printer section or color image recording device.

The construction and operation of the scanner section will be briefly described first. The scanner section includes a glass platen on which a document is laid. While scanning optics including a lamp, mirrors and a lens optically scans the document, the resulting reflection form the document is incident to a color image sensor. The color image sensor reads color image information color by color, e.g., on a B (blue), G (green) and R (red) basis while transforming them to corresponding color-by-color electric image signals. The color image sensor is implemented by B, G and R color separating means and CCDs (Charge Coupled Devices) or similar photoelectric transducers and capable of reading the three colors at a time. An image processing section converts the B, G and R image signals output from the scanner section to Bk (black), C (cyan), M (Magenta) and Y (Yellow) color image data. More specifically, the scanning optics scans the document in response to a start signal synchronous to the operation of the printer section, causing the above color image data to be output. In the illustrative embodiment, because the image processing section outputs image data of one color every time the scanning optics scans the document, the optics repeats its scanning operation four consecutive times in order to output Bk, C, M and Y color image data.

Figure 1:
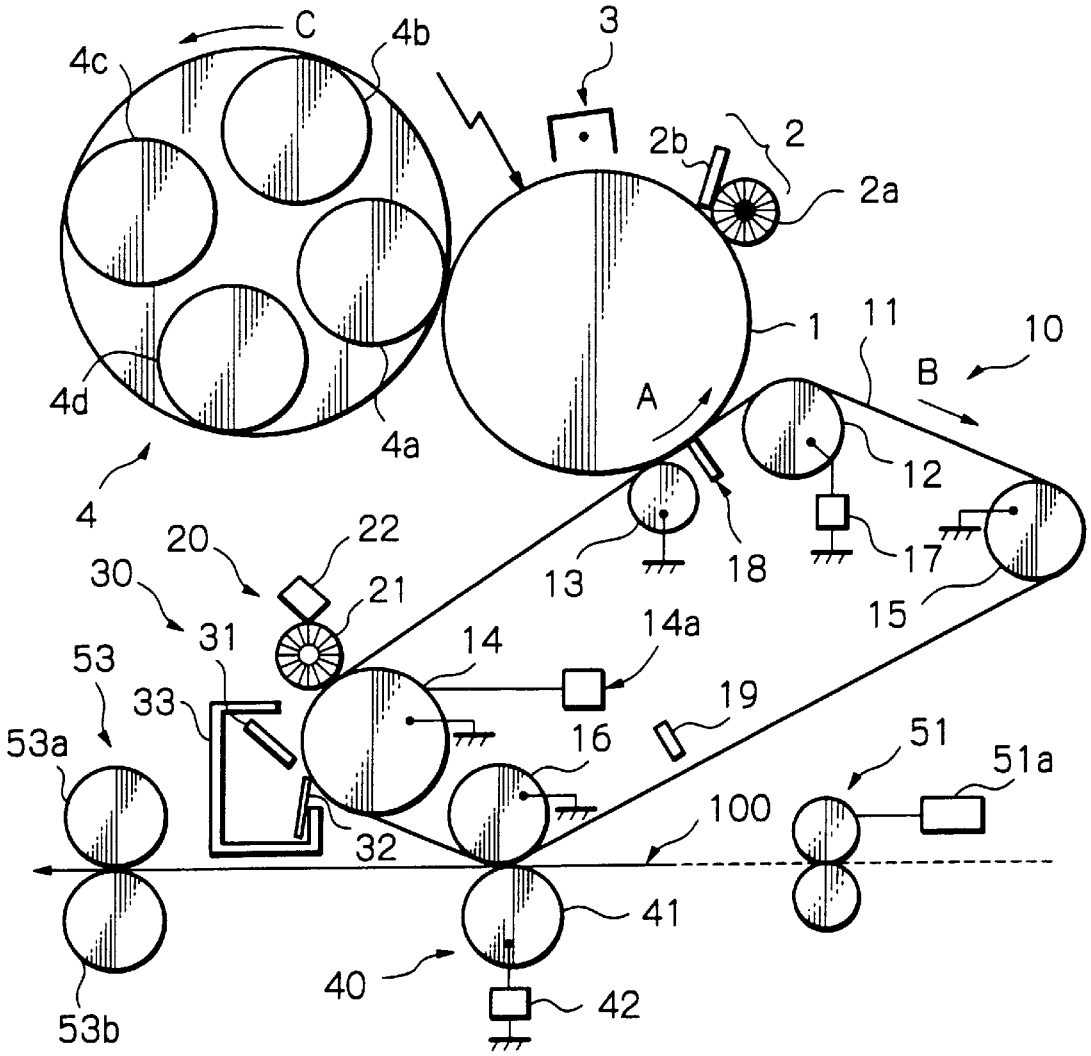
FIG. 1 is a view showing an image forming apparatus embodying the present invention.

As shown in FIG. 1, the printer section includes an optical writing unit or exposing means, not shown, and a photoconductive drum or image carrier 1. The optical writing unit transforms the color image data received from the scanner section to an optical signal color by color and forms a negative latent image corresponding to the document image on the drum 1 uniformly charged to negative polarity beforehand. The writing unit may include a semiconductor laser, a control section for controllably driving the laser, a polygonal mirror, a motor for driving the polygonal mirror, an f/θ lens, and a mirror. The drum 1 is caused to rotate counterclockwise, as indicated by an arrow A in FIG. 1.

Arranged around the drum 1 are a drum cleaning device or cleaning means 2, a charger or charging means 3, a developing unit or developing means 4, and an intermediate image transfer unit or intermediate image transferring means 10. In the illustrative embodiment, the developing unit 4 is implemented as a revolver type developing unit and will be simply referred to as a revolver hereinafter. The drum cleaning device 2 includes a fur brush 2*a* and a cleaning blade 2*b* and cleans the surface of the drum 1 after primary image transfer. The charger 3 uniformly charges the surface of the drum 1 cleaned by the cleaning device 2 to negative polarity.

The revolver 4 is made up of a developing unit and a toner storing unit. The developing unit has a Bk developing section 4*a*, a C developing section 4*b*, an M developing section 4*c*, and a Y developing section 4*d* while the toner storing unit has a plurality of toner storing sections. The revolver 4 is revolvable in a direction indicated by an arrow C in FIG. 1 to locate any one of the developing sections 4*a*–4*d* at a preselected developing section where it faces the drum 1. In FIG. 1, the Bk developing unit 4*a* is shown as located at the developing position. The developing sections 4*a*–4*d* are identical in configuration, and each includes a paddle or agitating means for agitating a developer, a toner content sensor or toner content sensing means, and a sleeve or developer carrier for causing the developer deposited thereon to contact the surface of the drum 1, although not shown specifically.

In the illustrative embodiment, developers of different colors stored in the developing sections 4*a*–4*d* each are a two-ingredient type developer, i.e., a toner and carrier mixture; the toner is charged to negative polarity. When the toner content of the developer stored in any one of the developing sections 4*a*–4*d* decreases due to repeated development, the toner content sensor assigned to the developing section senses the decrease of toner content. In response to the resulting output of the toner content sensor, toner of the same color as the above toner is replenished to the developing section from one of toner bottles, not shown, mounted on the toner storing unit. As a result, the toner content of the developer is maintained constant.

In the intermediate image transfer unit 10, an intermediate image transfer belt or intermediate image transfer body 11 is passed over a primary transfer bias roller or charge depositing means 12, a ground roller or primary transfer predischarging means 13, a drive roller or belt driving means 14, a tension roller 15, and a counter roller 16 which is used to effect secondary image transfer which will be described later. A primary transfer power supply 17 applies a bias for primary image transfer to the bias roller 12. A belt drive motor 14*a* drives the belt 14 under the control of a controller or control means 60 (see FIG. 3). All the rollers 12–16 over which the belt 11 is passed are formed of a conductive material, and the rollers 13–16 are connected to ground.

The bias roller 12 is positioned downstream of, but close to, a primary image transfer region or nip where the belt 11 and drum 1 contact each other in the direction in which the surface of the belt 11 moves (direction of belt movement hereinafter), i.e., in a direction indicated by an arrow B in FIG. 1. The ground roller 13 connected to ground is located upstream of, but close to, the primary image transfer region in the direction of belt movement B. The bias roller 12 and ground roller 13 press the belt 11 against the drum 1, so that the above nip is formed between the roller 13 and the drum 1.

The belt 11 has a laminate structure made up of a surface layer, an intermediate layer, and a base layer. The belt 11 is positioned such that the surface layer faces the drum 1 while the base layer is remotest from the drum 1. An adhesive layer intervenes between the intermediate layer and the base layer for adhering themto each other. The belt 11 has a medium volume resistivity ρv of about $10^{11}$ Ωcm, as measured by a method prescribed by JIS (Japanese Industrial Standards) K6911. While the belt 11 may have a volume resistivity ρv of $10^{12}$ Ωcm or above in order to effectively obviate toner scattering after the primary image transfer, the belt 11 with such a volume resistivity must be discharged after the secondary transfer. Volume resistivities ρv of $10^{14}$ Ωcm or above would lower the durability of the belt 11. The belt 11 is so configured as to have a surface resistance of about $10^{13}$ $\Omega/cm^2$ on its surface layer.

Reinforcing members, not shown, are fitted on opposite widthwise edges of the inner surface of the belt 11. While the reinforcing members serve to prevent the belt 11 from twisting or otherwise deforming, they are apt to form gaps between the above edges of the belt 11 and the drum 1 at the time of primary image transfer. In light of this, backup members 18 abut against the opposite edges of the belt 11 in order to fill up the gaps.

The intermediate image transfer unit 10 additionally includes a mark sensor 19 adjoining the inner surface of the belt 11. The mark sensor or angular position sensing means 19 is connected to the controller 60, FIG. 3, and is responsive to a mark provided on the inner surface of the belt 11. In response to the output of the mark sensor 19, the controller 60 determines the position of an image formed on the belt 11.

A lubricant applying device or lubricant applying means 20, a belt cleaning device or belt cleaning means 30 and a secondary image transfer unit or secondary image transferring means 40 are arranged around the belt 11. Moving mechanisms each selectively move associated one of the lubricant applying device 20, belt cleaning device 30 and secondary image transfer unit 40 into or out of contact with the belt 11.

The lubricant applying device 20 is made up of a brush roller or lubricant applying member 21 and a case 22 accommodating a solid lubricant and springs, not shown specifically. The solid lubricant may be implemented by fine zinc stearate particles molded in a plate-like configuration. The springs constantly press the solid lubricant against the brush roller 21. Drive means, not shown, causes the brush roller 21 to rotate. After the secondary image transfer, the brush roller 21 is rotated to shave off the solid lubricant and applies the resulting powder to the belt 11. At this instant, the brush roller 21 moves in the same direction as the belt 11 at a position where the roller 21 contacts the belt 11, so that the bristles of the roller 21 are prevented from collapsing. In addition, the brush roller 21 is so control led as to move at a higher linear velocity than the belt 11 at a lubricant applying position where the roller 21 and belt 11 contact each other.

The belt cleaning device 30 is made up of a cleaning blade or cleaning member 31, an inlet seal or sealing means 32, and a casing 33. Toner removed from the belt 11 by the cleaning blade 31 is collected in the casing 33. The inlet seal 32 receives the above toner and guides it into the casing 33. This successfully prevents the toner from flying about in the apparatus.

The secondary image transfer unit 40 includes a secondary transfer bias roller 41 facing the previously mentioned counter roller 16 of the intermediate image transfer unit 10. A secondary transfer power supply 42 is connected to the bias roller 41. At the time when an image formed on the belt 11 is to be transferred to a sheet or recording medium 100 at a secondary image transfer region between the transfer roller 41 and the counter roller 16, the power supply 42 applies a bias for secondary image transfer to the bias roller 41. The image transfer unit 40 is angularly movable about a shaft, not shown, into or out of contact with the belt 11 when applied with a drive force via a secondary transfer clutch, not shown.

The printer section additionally includes a registration roller pair 51 adjoining the upstream side of the secondary image transfer region in the direction in which the sheet 100 is fed. The sheet 100 is paid out from a cassette or a manual feed tray assigned to special sheets including OHP sheets and thick sheets. A roller drive motor 51*a* causes the registration roller pair 51 to convey the sheet 100 toward the secondary image transfer region in response to a control signal fed from the controller 60.

The printer section further includes a sheet conveyor unit, not shown, a fixing unit or fixing means 53, and a copy tray, not shown. The fixing unit 53 includes a heat roller 53*a* and a press roller 53*b* for fixing a toner image transferred from the belt 11 to the sheet 100 with heat and pressure.

In the illustrative embodiment, first drive means causes the revolver 4 to rotate to locate any one of the developing sections 4*a*–4*d* at the developing position. Also, second drive means causes the developing sleeve or image forming member of the developing section brought to the developing position to rotate. The first and second drive means will be referred to as revolver drive means and sleeve drive means, respectively, hereinafter.

The revolver drive means is generally made up of a drive source for driving the developing unit and toner storing unit of the revolver 4 in order to locate desired one of the developing sections 4*a*–4*d* at the developing position, and a drive transmission mechanism for transmitting a drive force from the drive source to the developing unit. Specifically, as shown in FIG. 2, the drive source is implemented by a revolver motor 101 while the drive transmission mechanism is implemented by a revolver drive gear 101*a* and a revolver gear 55. For the revolver motor 101, use should preferably be made of a stepping motor in order to accurately stop the rotation of the revolver 4. The revolver motor 101 is mounted on a rear wall, not shown, included in the copier body and drives the revolver drive gear 101*a*. The revolver drive gear 101*a* is also mounted on the above rear wall and held in mesh with the revolver gear 55 mounted on the rear wall of the revolver 4. A drive force output from the revolver motor 101 is transmitted to the revolver gear 55 via the revolver drive gear 101*a*, causing the developing unit and developer storing unit of the revolver 4 to rotate integrally with each other.

The sleeve drive means includes a sleeve drive motor, not shown, for driving the developing sleeve and a drive transmission mechanism for transmitting a drive force from the motor to the sleeve. The drive transmission mechanism includes drive input gears each being assigned to a particular one of the developing sections 4*a*–4*d* of the revolver 4, and a drive gear capable of meshing with the drive input gear of the developing section located at the developing section. The drive force is transferred from the drive gear to the drive input gear meshing with the drive gear in such a direction that it assists the developing unit in rotating. Specifically, as shown in FIG. 2, drive input gears 212Bk, 212Y, 212M and 212C are mounted on the revolver 4 and respectively assigned to the developing sect ions 4*a*–4*d*. A drive gear 213 is mounted on the copier body and driven by the sleeve drive motor. The drive input gears 212Bk–212C and drive gear 213 each are rotated in a particular direction indicated by an arrow in FIG. 2.

More specifically, the drive input gears 212Bk–212C are rotatably mounted on the rear of the rear wall of the revolver 4. When the drive input gears 212Bk, for example, is brought into mesh with the drive gears 213, the rotation of the sleeve drive motor is transmitted to the developing sleeve, labeled 202Bk, included in the Bk developing unit 4*a*. In FIG. 2, the drive gear 213 is shown as meshing with the drive input gear 212Bk. The drive gear 213 and drive input gears 212Bk–212C are arranged such that the gears 212Bk–212C each start meshing with the gear 213 in the forward direction before the developing section corresponding to the gear arrives at the developing position.

To move a desired one of the developing sections 4*a*–4*d* to the developing position, the revolver motor 101 drives the developing unit and toner storing unit of the revolver 4 in a direction indicated by an arrow C in FIG. 2. As soon as the desired developing section, e.g., the Bk developing section 4*a*, reaches the developing position, the drive input gear 212Bk of the developing section 4*a* is brought into mesh with the drive gear 213. As a result, the sleeve drive motor mounted on the copier body drives the developing sleeve 202Bk via a clutch, not shown, and drive gear 201Bk.

A specific operation of the illustrative embodiment will be described hereinafter on the assumption that a Bk, a C, an M and a Y latent image are sequentially developed in this order.

On the start of a copying operation, the scanner section reads color image data out of a document. In the printer section, the writing unit scans the drum 1 with a laser beam in accordance with Bk image data derived from the above color image data, thereby forming a Bk latent image on the drum 1. The Bk developing section 4*a* of the revolver 4 develops the Bk latent image with Bk toner to thereby form a Bk toner image. To insure the development of the Bk latent image, the developing sleeve of the Bk developing section 4*a* is brought to the developing position before the leading edge of the Bk latent image arrives at the developing position. That is, the ear of the Bk developer deposited on the sleeve is brought to an operative position before the arrival of the leading edge of the Bk latent image at the developing position, so that the entire Bk latent image is surely developed. As soon as the trailing edge of the Bk latent image moves away from the developing position, the developer deposited on the sleeve of the Bk developing section 4*a* is rendered inoperative. This is completed at least before the leading edge of a C latent image to be developed next arrives at the developing position. To render the above developer of the sleeve inoperative, the developing sleeve may be rotated in the direction opposite to the direction assigned to development.

The Bk toner image formed on the drum 1 by the above procedure is transferred to the surface of the belt 11 moving at the same speed as the drum 1 (primary image transfer).

In parallel with the primary transfer of the Bk toner image, the scanner section again reads the color image data out of the document at a preselected timing. The writing unit scans the drum 1 with a laser beam in accordance with C image data derived from the color image data so as to form a C toner image. The C developing section 4*b* of the revolver 4 develops the C latent image to thereby form a C toner image. The developing sleeve of the C developing section 4C is caused to start rotating after the trailing edge of the Bk latent image has moved away from the developing position, but before the leading edge of the C latent image arrives at the developing position. After the trailing edge of the C latent image has moved away from the developing position, the developer deposited on the above sleeve is brought to an inoperative position. This is also completed before the leading edge of an M latent image to be developed next arrives at the developing position. The C toner image is transferred from the drum 1 to the belt 11 over and in accurate register with the Bk toner image existing on the belt 11.

The same procedure is repeated with an M latent image and a Y latent image. As a result, an M and a Y toner image are sequentially transferred from the drum 1 to the belt 11 over the composite Bk and C toner image existing on the belt 11. Consequently, a composite Bk, C, M or Y toner image or full-color toner image is completed on the belt 11.

The moving mechanisms stated earlier maintain the cleaning blade 31 and inlet seal 32 of the belt cleaning device 30 and the secondary transfer bias roller 41 of the image transfer unit 40 spaced from the belt 11 until the full-color toner image has been completed on the belt 11, i.e., during the interval between the primary transfer of the Bk toner image and the primary transfer of the Y toner image.

The belt 11 conveys the full-color toner image to the secondary image transfer region to which the sheet 100 is fed. Usually, the moving mechanism assigned to the secondary transfer bias roller 41 moves the roller 41 into contact with the belt 11 at the time when the toner image is transferred from the belt 11 to the sheet 100 (secondary image transfer). Subsequently, the secondary transfer power supply 42 applies a preselected bias to the bias roller 41 with the result that an electric field for secondary image transfer is formed in the secondary image transfer region. Consequently, the toner image is transferred from the belt 11 to the sheet 100. It is to be noted that the sheet 100 is fed from a cassette selected on an operation panel, not shown, to the secondary image transfer region via the registration roller pair 51. More specifically, the registration roller pair 51 drives the sheet 100 at such a timing that the leading edge of the sheet 100 meets the leading edge of the toner image carried on the belt 11 at the secondary image transfer region.

The sheet 100 carrying the full-color toner image thereon is conveyed to the fixing unit 53 by the sheet conveyor unit mentioned earlier. After the toner image has been fixed on the sheet 100 by the fixing unit 53, the sheet or copy 100 is driven out of the copier to the copy tray.

After the primary transfer, the drum cleaning unit 2 cleans the surface of the drum 1. Subsequently, a discharge lamp or discharging means, not shown, discharges the surface of the drum 1. After the secondary transfer, the moving means assigned to the belt cleaning device 30 moves the cleaning blade 31 and inlet seal 32 into contact with the belt 11 in order to clean the surface of the belt 11. In the illustrative embodiment, the cleaning blade 31 and inlet seal 32 are moved by a single moving mechanism by way of example.

In a repeat copy mode, the scanner section reads the first color or Bk image information for the second copy at a preselected timing after reading the fourth color or Y image information for the first copy. The printer section forms a Bk latent image on the drum 1 in accordance with the Bk image information and then develops it to produce a Bk toner image. This Bk toner image is transferred from the drum 1 to the area of the belt 11 having been cleaned by the belt cleaning device 30 after the secondary transfer of the first full-color toner image.

In a tricolor or a bicolor copy mode, the illustrative embodiment operates in the same manner as in the above full-color copy mode except for the colors used. Further, in a monocolor copy mode, only the developer of the developing section corresponding to a desired color is maintained operative while the belt 1 is continuously driven in the forward direction. At this instant, the brush roller 21, cleaning blade 31, inlet seal 32 and secondary transfer bias roller 41 are held in contact with the belt 11, and the belt 11 is held in contact with the drum 1.

Figure 3:
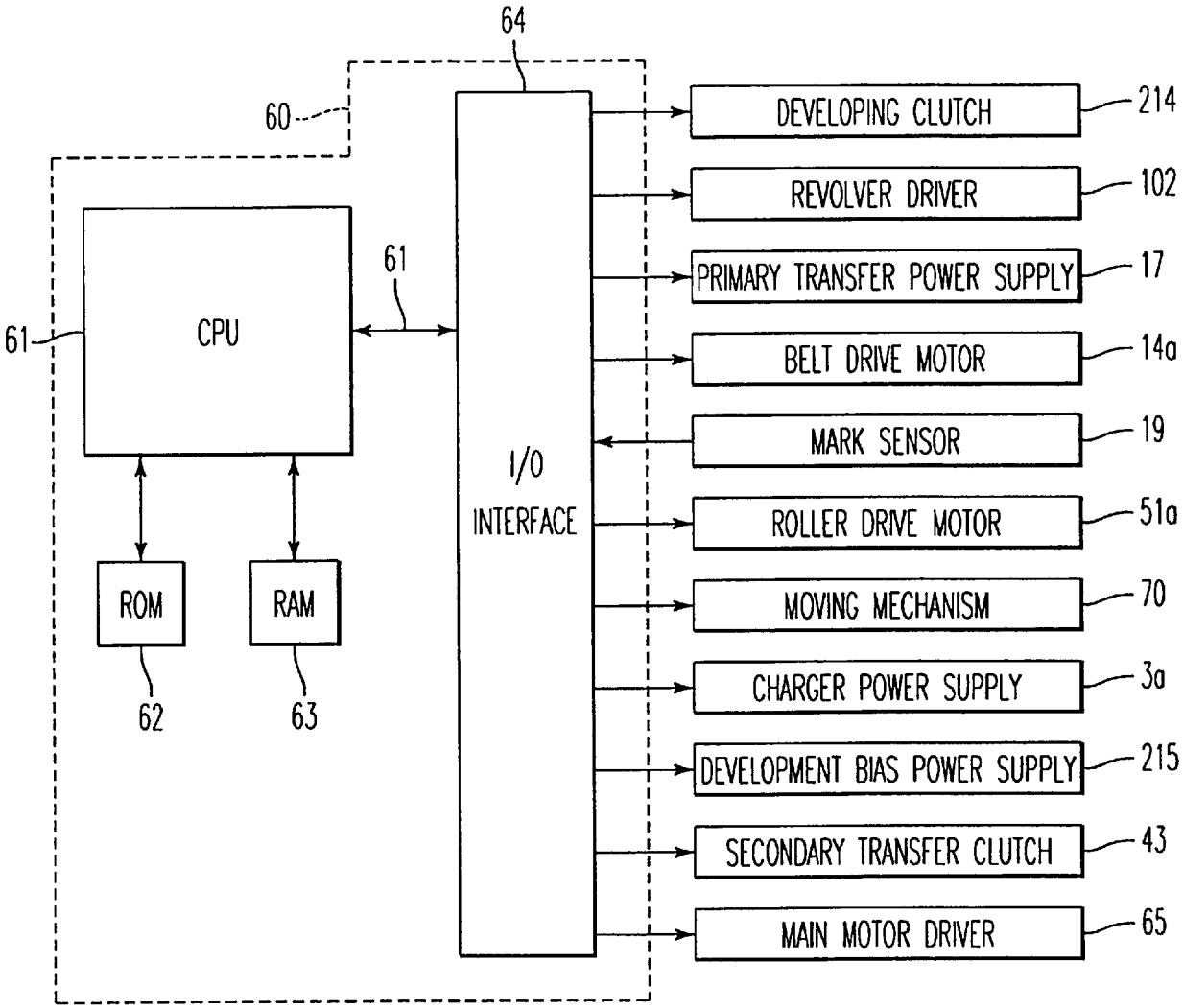
FIG. 3 is a block diagram schematically showing a controller included in the illustrative embodiment.

FIG. 3 shows the controller 60 included in the illustrative embodiment. As shown, the controller 60 includes a CPU (Central Processing Unit) 61, a ROM (Read Only Memory) 62, a RAM (Random Access Memory) 63, and an I/O (Input/Output) interface 64. Connected to the I/O interface 64 are the primary transfer power supply 17, belt drive motor 14*a*, mark sensor 19, roller drive motor 51*a*, and moving mechanism, labeled 70, for moving the brush roller 21, cleaning blade 31 and inlet seal 32 as well as a development clutch 214 and a revolver driver 102. The development clutch 214 selectively sets up or interrupts drive transmission to the developing sleeve of the developing section located at the developing position. The revolver driver 102 drives the revolver motor 101. Additionally connected to the I/O interface 64 are a charge power supply for applying a voltage to the charger 3, a development bias power supply 215 for applying a bias voltage to the developing rollers 202, the secondary transfer clutch 43 mentioned earlier, and a main motor driver 65 for driving a main motor, not shown.

In the illustrative embodiment, the controller 60 accurately determines the position of an image formed on the belt 11 on the basis of the output of the mark sensor 19. On determining the position of the image, the controller 60 controls the operation of the moving mechanism 70 and the operation of the registration roller pair 51 in accordance with the position of the image. Specifically, to control the operation timing of the registration roller pair 51, the controller 60 calculates a period of time necessary for the leading edge of the image on the belt 11 to arrive at the secondary image transfer region on the basis of the running speed of the belt 11.

At the time of secondary image transfer, the controller 60 causes the belt 11 to rotate at a particular speed in each of a plain sheet mode in which the sheet 100 is a plain sheet and a thick sheet mode in which the sheet 100 is a thick sheet or an OHP sheet. Specifically, the controller 60 controls the belt drive motor 14*a* such that in the thick sheet mode the belt 11 runs at a speed one half of a speed assigned to the plain sheet mode.

In the plain sheet mode, the belt 11 runs at the same speed for both of primary image transfer and secondary image transfer. However, in the thick sheet mode, it is necessary to reduce the running speed of the belt 11 to one half of the speed assigned to the plain sheet mode. More specifically, the running speed of the belt 11 must be halved after the primary transfer of the toner image of the last color from the drum 1 to the belt 11, but before the secondary transfer of the resulting full-color image from the belt 11 to the sheet 100. At this instant, it is almost impracticable to accurately set such a variation of the running speed of the belt 11. It is therefore extremely difficult for the controller 60 to accurately determine the position of the image carried on the belt 11 after the variation of the above speed. As a result, a difference occurs between the position determined by the controller 60 and the actual position. Therefore, after the speed of the belt 11 has been halved and then stabilized, the mark provided on the belt 11 must be again brought to the mark sensing position, so that the controller 60 can again recognize the position of the image.

Assume that a so-called P pattern for toner content control is formed on the belt 11 at the trailing edge of the image or at the rear of the same. Then, the leading edge of the image usually arrives at the secondary image transfer region before the trailing edge of the P pattern moves away from the primary image transfer region. Alternatively, the leading edge of the image on the belt 11 arrives at the secondary image transfer region before the belt 11 is decelerated and then stabilized. In light of this, it has been customary to cause, after the primary image transfer, the belt 11 to run idle for conveying the image via the secondary image transfer region once, thereby allowing the controller 60 to again recognize the position of the image. This is followed by the secondary image transfer. Such an idle run is not necessary if the belt 11 can be decelerated and stabilized before the leading edge of the image arrives at the secondary image transfer region. However, this is not practicable without changing the construction, e.g., increasing the length of the belt 11 and moreover increasing the overall size of the image transfer unit 10.

During the above idle run of the belt 11, the image on the belt 11 again moves via the primary image transfer region. In the illustrative embodiment, while the belt 11 is running idle, the controller controls the revolver driver 101*b* such that the developing section of the revolver 4 which developed a latent image last before the start of idle rotation remains at the developing position.

Figure 4:
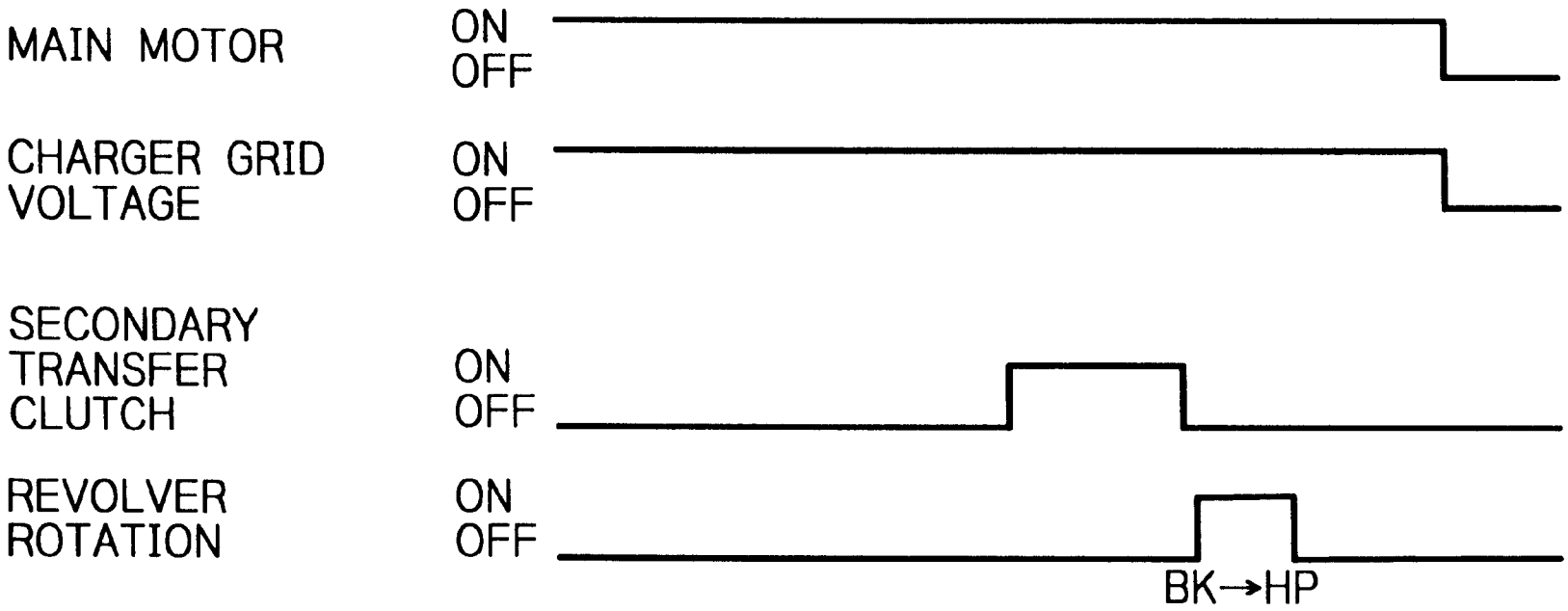
FIGS. 4 and 5 are timing charts each demonstrating particular control available with the illustrative embodiment.

FIG. 4 is a timing chart showing a specific control over the main motor, charger 3, secondary transfer clutch and revolver 4 occurring at the end of a copying operation effected in the thick sheet mode for producing a single monocolor (black) copy. In FIG. 4, after the image transfer from the drum 1 to the belt 11, the belt 11 is caused to run idle at the half speed. During the idle run of the belt 11, the image carried on the belt 11 moves via the primary image transfer region. However, because the Bk developing section 4*a* is held at the developing position, the drum 1 and belt 11 are free from the band-like contamination ascribable to the deposition of the toner. This kind of contamination is apt to occur when the developing section arrives at or leaves the developing position.

Further, in the illustrative embodiment, when the Bk developing unit 4*a* is held at the developing position, the bias voltage usually applied to the developing sleeve 201Bk of the Bk developing section 4*a* for image formation is replaced with a bias voltage causing a minimum of toner to be transferred from the sleeve 201Bk to the drum 1. This is successful to reduce the contamination of the background of the drum 1 and that of the background of the toner image carried on the belt 11 and therefore the background of the sheet 100.

During the idle run of the belt 11, the controller 60 again recognizes the position of the image carried on the belt 11 on the basis of the output of the mark sensor 19, as stated earlier. The controller 60 then couples the secondary transfer clutch 43 in order to transfer the image from the belt 11 to the sheet 100. Subsequently, the controller 60 causes the revolver 4 to return to its home position (HP) via the revolver driver 102 and then turns off the main motor and charger 3. With such control, it is possible to obviate the band-like contamination otherwise appearing on the sheet 100 in the widthwise direction during idle.

In the specific control shown in FIG. 4, the Bk developing section 4*a* is held at the developing position during the idle run of the belt 11. Alternatively, the revolver 4 may be slightly rotated to locate none of the developing sections thereof at the developing position. This successfully reduces contamination during idle run.

Figure 5:
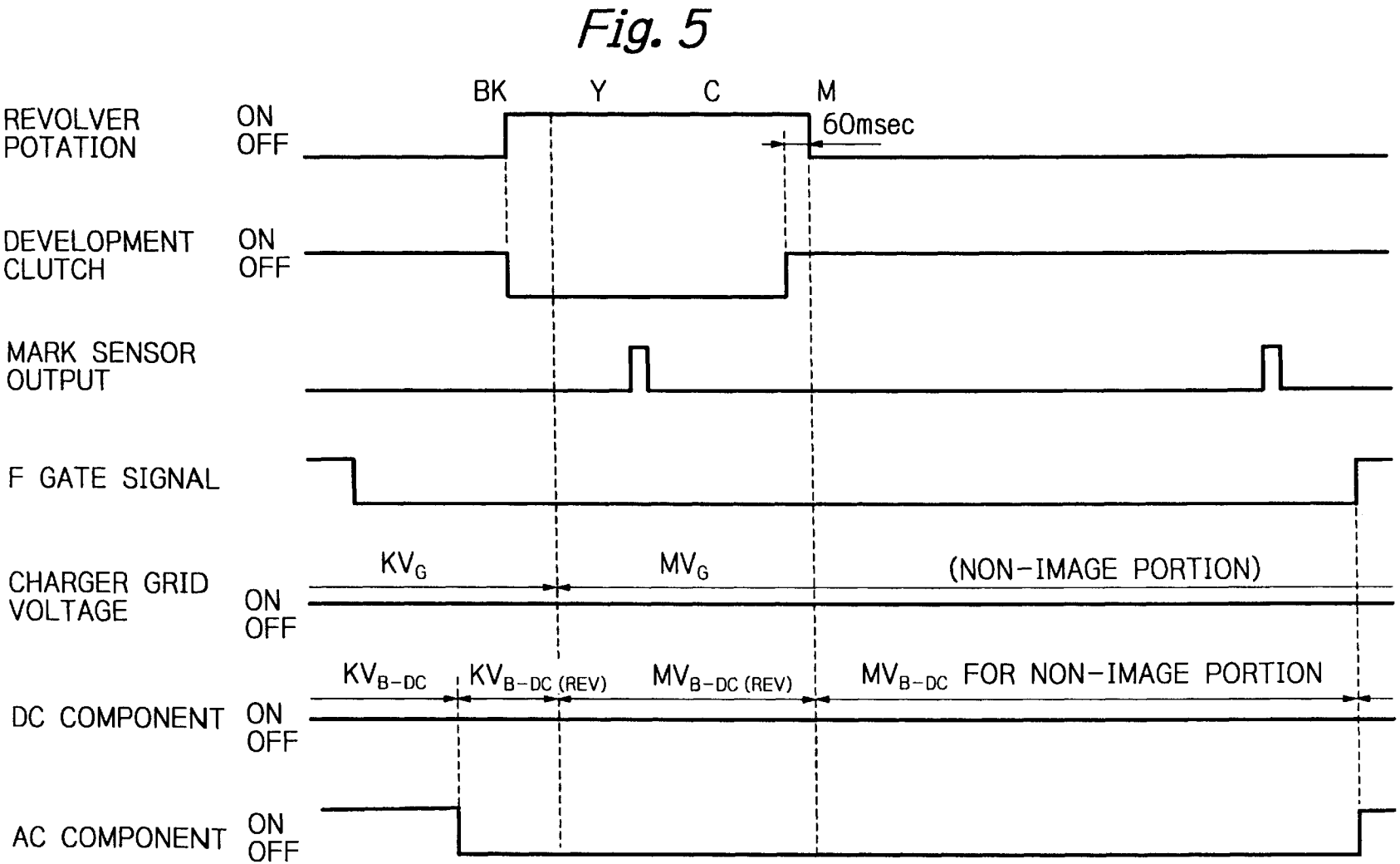

FIG. 5 shows another specific control effected at the time of switching of the developing sections in the bicolor copy mode using black and magenta by way of example. As shown, after a gate signal (F gate signal) for writing a black image has been turned off, the black image formed on the drum 1 by the Bk developing section 4*a* is transferred to the belt 11. Then, an AC component included in the bias for development is interrupted in order to avoid noise. At the same time, a DC component also included in the bias is switched from $BkV_{B\text{-}DC}$ for usual image formation to $BkV_{B\text{-}DC(REV)}$ (=$BkV_D$−350 V) where $BkV_D$ is a charge potential to be deposited on the drum 1 for the Bk developing section 4*a*; $BkV_{B\text{-}DC(REV)}$ is a condition for reducing background contamination. The voltage of 350 V successfully prevents the toner from depositing on the drum 1 even when the developing sections whose developing sleeves are not rotating, i.e., the Y and C developing sections, move via the developing position. Subsequently, the controller 60 causes the revolver 4 to start rotating and uncouples the development clutch 214. Because the drive transmission to the developing roller involves a time lag of about 20 msec to 30 msec, the Bk developing section 4*a* leaves the developing position with its developing roller being rotated.

Subsequently, when the revolver 4 is rotated by about 45 degrees, i.e., before the next or Y developing section 4*d* arrives at the developing position, the voltage applied to the grid of the charger 3 is switched from $BkV_G$ assigned to the Bk developing section 4*a* to $MV_G$ assigned to the M developing section 4*b*. At the same time, the DC component of the bias is switched from $BkV_{B\text{-}DC(REV)}$ (=$BkV_D$−350 V) to $MV_{B\text{-}DC(REV)}$ (=$MV_D$−350 V) which is a condition for reducing background contamination ascribable to the M developing section 4*b*.

About 60 msec before the stop of the above rotation of the revolver 4, the development clutch 214 is coupled, and the drive input gear 212M of the M developing section 4*b* starts meshing with the drive gear 213. As a result, the ear of the developer deposited on the developing sleeve 201M of the M developing section 4*b* starts contacting the drum 1 in the same manner as during usual image formation. This reduces the needless deposition of the toner on the drum 1 when the developing section 4*b* moves to the developing position.

At the time when the M developing section 4*b* arrives at the developing position, a mark M provided on the belt 11 has already moved away from the sensing position where the mark sensor 19 is positioned. Therefore, the belt 11 is caused to continuously run idle. Then, the DC component of the bias is switched from $MV_{B\text{-}DC(REV)}$ (=$MV_D$−350 V) to $MV_{B\text{-}DC}$($MV_D$−250 V) which is a condition for reducing the background contamination of a non-image area ascribable to the M developing section 4*b*. In this condition, the needless transfer of the toner from the M developing sect ion 4*b* held at the developing position to the drum 1 is reduced, so that background contamination is obviated.

On the elapse of a preselected period of time since the mark sensor 19 has sensed the mark M of the belt 11, the gate signal (F gate signal) for writing an M image is turned on. Subsequently, the AC component of the bias is turned on, and the DC component of the same is switched from $MV_{B\text{-}DC}$ (=$MV_D$−250 V) to $MV_{B\text{-}DC}$ which is the usual condition for image formation. The M developing section 4*b* then starts its image forming operation.

As stated above, the illustrative embodiment controls the rotation of the revolver 4 and that of the developing sleeve so as to cause a minimum of toner to needlessly deposit on the belt 11 in the form of a band during the idle run of the belt 11. This is successful to obviate band-like contamination (lateral color band in the case of a color image) extending in the lateral or widthwise direction of the sheet 100.

Further, during the idle run of the belt 11, the illustrative embodiment applies to the developing sleeves 201Bk and 202M sequentially brought to the developing position during idle run a bias causing a minimum of toner to move from the developing sleeve to the drum 1. Therefore, the needless deposition of the toner on the belt 11 running idle and therefore the background contamination of the sheet 100 is reduced. Particularly, the illustrative embodiment assigns a particular background reduction condition to each of the developing sections 4*a* and 4*b* and can therefore reduce background contamination more positively. While the illustrative embodiment switches the bias to be applied to each developing sleeve in order to reduce background contamination, the charging condition of the charger 3 (e.g. grid voltage) may be switched in place of or in addition to the above bias.

Experimental results obtained with a more specific construction of the above copier will be described hereinafter.

During the idle rotation of the belt 11, a developing gap PG of each developing section and the amount of developer drawn to each developing sleeve were varied for the purpose of evaluating the resulting image quality. The developing section was brought to the developing position with its developing sleeve being rotated and with the developer forming an ear on the sleeve and contacting the drum 1. A potential difference between the sleeve and the drum 1 during the idle run of the belt 11 was selected to be 350 V.

FIG. 6 lists the results of experiments conducted under the above conditions. In FIG. 6, circles are representative of the absence of the lateral color band while the word "rough" is representative of rough images ascribable to the short deposition of toner. Amounts of draw ρ (g/cm$^2$) listed in FIG. 6 each were determined by collecting the developer with a magnet and measuring its weight with respect to a preselected area (2 cm$^2$) of the surface of the developing sleet moved away from a doctor gap DG (mm). Further, doctor gaps DG shown in FIG. 6 were determined on the basis of the amounts of draw ρ by using a relation between the doctor gap DG and the amount of draw ρ derived from another series of experiments.

As FIG. 6 indicates, when the developing gap PG ranges from 0.55 mm to 0.70 mm and when the amount of draw of the developer ranges from 0.050 g/cm$^2$ to 0.060 g/cm$_2$, there can be obviated the lateral color band and rough images.

In summary, an image forming apparatus of the present invention minimizes the background contamination of a recording medium ascribable to toner deposited on an image carrier during the idle run of an intermediate image transfer body. Further, the apparatus allows a minimum of toner to needlessly deposit on the intermediate image transfer body during idle run. This reduces band-like contamination extending laterally on a recording medium and obviates rough images during usual image formation.

Various modifications will become possible for those skilled in the art after receiving the teachings of the present disclosure without departing from the scope thereof.

What is claimed is:

1. An image forming apparatus comprising:

an apparatus body;

an image carrier for carrying a latent image thereon;

a developing unit including a plurality of developing sections each for developing a particular latent image formed on said image carrier to thereby produce a toner image, said developing unit being rotatably supported by said apparatus body;

drive means for causing said developing unit to rotate;

an intermediate image transfer body having an endless movable surface to which the toner image is transferred from said image carrier; and control means for controlling, while said intermediate image transfer body is running idle, said drive means such that one of said plurality of developing sections operated last before a start of an idle run remains at a developing position.

2. An image forming apparatus comprising:

an apparatus body;

an image carrier for carrying a latent image thereon;

a developing unit including a plurality of developing sections each for developing a particular latent image formed on said image carrier to thereby produce a toner image, said developing unit being rotatably supported by said apparatus body;

drive means for causing said developing unit to rotate;

an intermediate image transfer body having an endless movable surface to which the toner image is transferred from said image carrier; and control means for controlling, while said intermediate image transfer body is running idle, said drive means such that one of said plurality of developing sections operated last before an idle run is located at a position other than a developing position and such that none of said plurality of developing sections moves via said developing position.

3. An image forming apparatus comprising:

an apparatus body;

an image carrier for carrying a latent image thereon;

a developing unit including a plurality of developing sections each for developing a particular latent image formed on said image carrier to thereby produce a toner image, said developing unit being rotatably supported by said apparatus body;

first drive means for causing said developing unit to rotate;

second drive means including a drive gear capable of meshing with, among drive input gears respectively included in said plurality of developing sections, a drive input gear of one developing section brought to a developing position where said one developing section faces said image carrier, thereby transmitting a drive force to a developer carrier included in said one developing section;

an intermediate image transfer body having an endless movable surface to which the toner image is transferred from said image carrier;

said drive input gears of said plurality of developing sections and said drive gear being arranged such that when any one of said plurality of developing sections moves toward the developing position while said intermediate image transfer body is running idle, a developer deposited on said developer carrier starts contacting said image carrier with said developer carrier rotating; and control means for controlling said first drive means and said second drive means.

4. An apparatus as claimed in claim 3, wherein when any one of said plurality of developing sections moves toward the developing position, said controller switches a potential difference between said developer carrier and said image carrier to a potential difference causing a minimum of toner to move from said developer carrier to said image carrier before the developer deposited on said developer carrier starts contacting said image carrier.

5. An apparatus as claimed in claim 4, wherein a developing gap between said developer carrier and said image carrier ranges from 0.55 mm to 0.70 mm while an amount of the developer deposited on said developer carrier moved away from a developer regulating member ranges from 0.050 g/cm$^2$ to 0.060 g/cm$^2$, said controller switching the potential difference to −350 V.

6. An image forming apparatus comprising:

an apparatus body;

an image carrier for carrying a latent image thereon;

latent image forming means for scanning a uniformly charged surface of said image carrier with light in accordance with image data to thereby form a latent image on said image carrier;

a developing unit including a plurality of developing sections each for developing a particular latent image formed on said image carrier to thereby produce a toner image, said developing unit being rotatably supported by said apparatus body;

drive means for causing said developing unit to rotate;

a power supply for applying a voltage to a developer carrier included in each of said plurality of developing sections; and an intermediate image transfer body having an endless movable surface to which the toner image is transferred from said image carrier, wherein one developing section located at a developing position is replaced with another developing section while said intermediate transfer body is running idle; and control means for controlling, while said intermediate image transfer body is running idle, said latent image forming means and said power supply such that at least one of a condition for charging said image carrier and a condition for applying the voltage to said developer carrier of one of said plurality of developing sections located at the developing position is switched to a condition causing a minimum of toner to move from said developer carrier to said image carrier to thereby reduce contamination of a background.

7. An apparatus as claimed in claim 6, wherein while said developing unit is rotating to switch the developing section, said control means switches the condition for reducing the contamination of the background from a condition assigned to the developing section located at the developing position before switching of the developing section to a condition assigned to another developing section to be located at the developing position after the switching of the developing section.

* * * * *